US009739575B2

(12) United States Patent
Hong

(10) Patent No.: US 9,739,575 B2
(45) Date of Patent: Aug. 22, 2017

(54) DART GAME SYSTEM

(71) Applicant: HONG INTERNATIONAL CORPORATION, Seoul (KR)

(72) Inventor: Sang Uk Hong, Seoul (KR)

(73) Assignee: HONG INTERNATIONAL CORPORATION, Seoul (KR)

( * ) Notice: Subject to any disclaimer, the term of this patent is extended or adjusted under 35 U.S.C. 154(b) by 46 days.

(21) Appl. No.: 14/612,836

(22) Filed: Feb. 3, 2015

(65) Prior Publication Data

US 2015/0145212 A1 May 28, 2015

Related U.S. Application Data

(63) Continuation of application No. PCT/KR2013/005259, filed on Jun. 14, 2013.

(30) Foreign Application Priority Data

Aug. 27, 2012 (KR) ..... 10-2012-0093647

(51) Int. Cl.
*F41J 3/00* (2006.01)
*F41J 5/04* (2006.01)
(Continued)

(52) U.S. Cl.
CPC ..... *F41J 3/0009* (2013.01); *F41J 3/0028* (2013.01); *F41J 3/02* (2013.01); *F41J 5/04* (2013.01);
(Continued)

(58) Field of Classification Search
CPC ..... F41J 5/04
(Continued)

(56) References Cited

U.S. PATENT DOCUMENTS 4,415,162 A 11/1983 Sheppard
5,486,007 A * 1/1996 Stewart ..... F41J 5/052 273/374
(Continued)

FOREIGN PATENT DOCUMENTS

CN 1180863 C 12/2004
GB 2314513 B 1/1998
(Continued)

OTHER PUBLICATIONS

International Search Report for PCT/KR2013/005259 dated Sep. 25, 2013.
(Continued)

*Primary Examiner* — Aarti B Berdichevsky
*Assistant Examiner* — Rayshun Peng
(74) *Attorney, Agent, or Firm* — Studebaker & Brackett PC

(57) ABSTRACT

The present disclosure relates to a dart game system. The dart game system includes a dart game device, multiple external facilities, and a control unit configured to control the dart game device and the multiple external facilities. The dart game device includes a dart target having a plurality of point regions, a sensing unit configured to sense a hit to the dart target by a dart, a light source unit configured to output light, and a sound source unit configured to output sound. The multiple external facilities includes additional light source units configured to output additional light, and additional sound source units configured to output additional sound. The control unit is configured to control the light source units and the sound source units to output light or sound according to patterns, which depend on an occurrence of an event.

10 Claims, 21 Drawing Sheets

(51) Int. Cl.

| | |
|---|---|
| ***F41J 5/14*** | (2006.01) |
| ***F41J 3/02*** | (2006.01) |
| ***F41J 5/24*** | (2006.01) |
| ***G07F 17/32*** | (2006.01) |

(52) U.S. Cl.
CPC . *F41J 5/14* (2013.01); *F41J 5/24* (2013.01); *G07F 17/3225* (2013.01)

(58) Field of Classification Search
USPC ..... 273/371, 374
See application file for complete search history.

(56) References Cited

U.S. PATENT DOCUMENTS

| | | | | |
|---|---|---|---|---|
| 5,857,912 | A * | 1/1999 | Freitag | F41J 3/02 273/371 |
| 7,361,083 | B2 * | 4/2008 | Valero Moreno | G07F 17/32 273/371 |
| 7,487,971 | B2 | 2/2009 | Angles | |
| 7,857,317 | B2 * | 12/2010 | Noda | F41J 5/00 273/245 |
| 2005/0006847 | A1 | 1/2005 | Ross | |
| 2005/0007153 | A1 | 1/2005 | Ding et al. | |
| 2009/0218769 | A1 * | 9/2009 | Krzewicki | A63D 15/20 273/374 |
| 2011/0111846 | A1 * | 5/2011 | Ciarrocchi | G10H 1/32 463/30 |
| 2011/0151969 | A1 | 6/2011 | Kobayashi et al. | |

FOREIGN PATENT DOCUMENTS

| | | | | |
|---|---|---|---|---|
| JP | 07299185 | A * | 11/1995 | A63D 5/04 |
| JP | 09-220364 | A | 8/1997 | |
| JP | 2006-212224 | A | 8/2006 | |
| JP | 2007-330546 | A | 12/2007 | |
| JP | 2009-225879 | A | 10/2009 | |
| JP | 2010-190487 | A | 9/2010 | |
| JP | 2010190487 | A * | 9/2010 | |
| KR | 1020110021069 | A | 3/2011 | |

OTHER PUBLICATIONS

European Search Report for corresponding European Patent Application No. 13833294.5 issued on Jul. 20, 2016.
Chinese Office Action for corresponding Chinese Patent Application No. 201380045103.3 issued on Dec. 2, 2016.
Japanese Office Action for corresponding Japanese Patent Application No. 2015-529657 issued on Jan. 4, 2017.

* cited by examiner

DART GAME SYSTEM

CROSS REFERENCE TO RELATED APPLICATION

This application claims the priority of Korean Patent Application No. 10-2012-0093647, filed on Aug. 27, 2012, in the KIPO (Korean Intellectual Property Office). Further, this application is a continuation of International Application No. PCT/KR2013/005259, filed Jun. 14, 2013, claiming priority from the above mentioned Korean Patent Applications, and designating the United States. This application is further related to U.S. application Ser. No. 14/611,798, titled "DART GAME DEVICE INTERWORKING WITH EXTERNAL DEVICE, GAMING SYSTEM AND METHOD", and naming Sang Uk Hong as the inventor. Each of the above listed applications is hereby incorporated by reference in their entirety into the present application.

TECHNICAL FIELD

The present disclosure relates to a dart game system including a dart game device and multiple external facilities having light source units which output light and sound source units which output sound.

BACKGROUND

The statements in this section merely provide background information related to the present disclosure and do not constitute prior art.

In general, a dart refers to a 'small arrow' and is one used for a dart game that makes marks by throwing an arrow-shaped dart pin to a centrifugal target marked with figures. The dart game has an advantage that whoever can enjoy the dart game regardless of season anytime anywhere if there are an arrowheaded dart and the dart target.

In recent years, while various game methods have been developed and a scoring method is arranged, and as a result, the dart game is developed to worldwide leisure, all adults and children have conveniently enjoyed the dart game.

When a player plays a game by using the dart game device, the player generally senses a change in flickering scheme and color of an illumination through the light source unit of the dart game device, and as a result, the player feels joy and pleasure of the dart game.

However, current dart game devices generate an illumination pattern when an event occurs (for example, hitting the dart target) in only their game devices.

SUMMARY

According to at least one aspect of the present disclosure, there is provide a dart game system comprising a dart game device, a plurality of facilities and a control unit. The dart game device comprising a dart target having a plurality of point regions, a sensing unit configured to sense a hit to the dart target by a dart, a light source unit configured to output light, and a sound source unit configured to output sound. The plurality of facilities comprising additional light source units configured to output additional light, and additional sound source units configured to output additional sound. The control unit configured to control the dart game device and the plurality of facilities, wherein the control unit is configured to control the light source unit of the dart game device and the additional light source units of the plurality of facilities to output light in a light pattern, which depends on an occurrence of an event, and wherein the control unit is configured to control the sound source unit of the dart game device and the additional sound source units of the plurality of facilities to output sound in a sound pattern, which depends on the occurrence of the event.

According to other aspect of the present disclosure, there is provided a dart game device. The dart game device comprises: a dart target having a plurality of point regions; a sensing unit configured to sense a hit to the dart target by a dart; and a floor part comprising light source units, wherein at least one of the light source units is configured to display a throw line, wherein the throw line is displayed on the floor part when the light source unit displaying the throw line is lit up, and wherein no throw line is visually recognizable when the light source unit displaying the throw line is not lit up.

According to other aspect of the present disclosure, there is provided a gaming system. The gaming system comprises a plurality of dart game devices interworking with each other. Each of the dart game devices comprising: a dart target having a plurality of point regions; a sensing unit configured to sense a hit to the dart target by a dart; and a floor part comprising light source units, wherein at least one of the light source units is configured to display a throw line, wherein the throw line is displayed on the floor part when the light source unit displaying the throw line is lit up, and wherein no throw line is visually recognizable when the light source unit displaying the throw line is not lit up.

Figure 1:
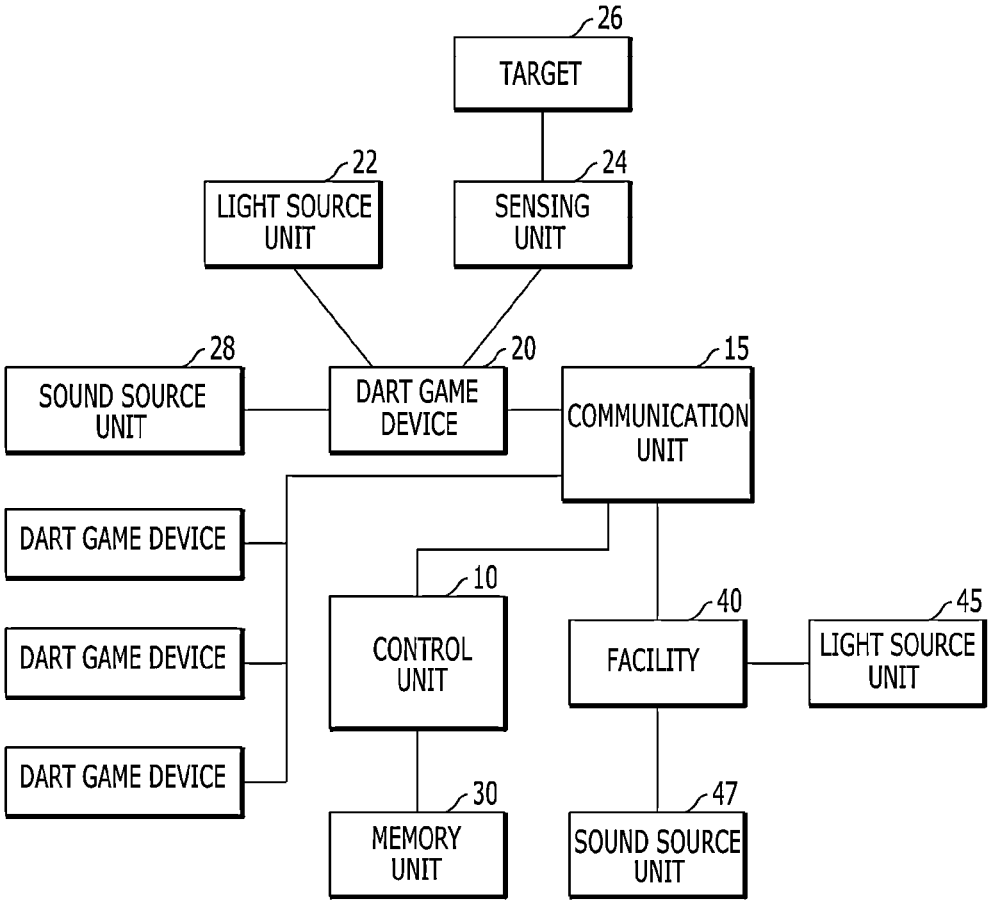
FIG. 1 is a schematic block diagram of a dart game system including an external facility having an light source unit according to some embodiments of the present disclosure.

Various embodiments are described with reference to the drawings and similar reference numerals are used to represent similar elements throughout the drawings. For description, in the specification, various descriptions are presented to provide appreciation of the present disclosure. However, it is apparent that the embodiments can be executed without the specific description. In other examples, known structures and devices are presented in a block diagram form in order to facilitate description of the embodiments.

DETAILED DESCRIPTION

The following description provides a brief description of one or more embodiments in order to provide basic appreciation of the present disclosure. This section is not a comprehensive overview for all available embodiments and does not intend to identify a core element among all elements or cover the scopes of all of the embodiments. An object of this section is to provide concepts of one or more embodiments in a simplified form as an introduction for a detailed description to be presented later.

A dart game system of the present disclosure has characteristics that a plurality of dart game devices including light source units are interlocked with a plurality of facilities having light source units, and as a result, patterns of a change in flickering schemes and colors of the light source units are executed by a control unit when a particular event occurs and the characteristics are implemented by the following configuration.

FIG. 1 is a schematic block diagram of a dart game system including an external facility having a light source unit according to some embodiments of the present disclosure.

As illustrated in FIG. 1, the dart game system according to the some embodiments of the present disclosure includes a dart game device 20; a control unit 10; a memory unit 30; and a facility 40. Meanwhile, in some embodiments, the dart game system includes a display unit; a voice output unit; and an operation unit in addition to separately from the components. In some embodiments, the dart game device 20 includes a dart target 26, a sensing unit 24, a light source unit 22, and a sound source unit 28. The dart target 26 includes a plurality of point regions and the dart target, but it is not limited to.

The sensing unit 24 as a part that senses a hit to the dart target 26 by a dart is a sensor that senses which part of the dart target the dart hits when the dart hits the dart target. The control unit 10 detects a region where the dart hits the target from the sensor and calculates the point and calculates the detected region to call a predetermined pattern of the corresponding point from the memory unit 30 and display the pattern through the light source unit 22; 45 and the sound source unit 28; 47. Meanwhile, this point is displayed even in the display unit.

The control unit 10, in some embodiments, includes one or more physical, actual storage devices. Examples of physical, actual storage devices include, but are not limited to, magnetic media such as, a hard disk, a floppy disk, and a magnetic tape, optical media such as a CD-ROM and a DVD, magneto-optical media such as a floptical disk, and a hardware device configured especially to store and execute a program, such as a ROM, a RAM, a solid state drive, and a flash memory. The control unit 10 is implemented, in some embodiments, by one or more programmed processors and/or application-specific integrated circuits (ASICs).

In one or more embodiments, each dart game device has a control unit (not shown) implemented by a programmed processor and/or an ASIC, and communicated (e.g., by a wired or wireless network) with the control unit 10 using the communication unit 15 of the dart game device.

In some embodiments, the light source unit 22 of the dart game device 20 is a light source unit 22 installed in the dart game device 20 itself. In some embodiments, the light source unit 22 is constituted by one or more light emitted diodes (LEDs), and the like but the light source unit 22 is not particularly limited to.

Meanwhile, in some embodiments, a plurality of dart game devices 20 is installed, and as a result, multiple players enjoy a dart game together by schemes such as a match-up scheme, and the like. Only four dart game devices 20 are illustrated in FIG. 1, but the number of dart game devices 20 is not limited to.

Figure 4:
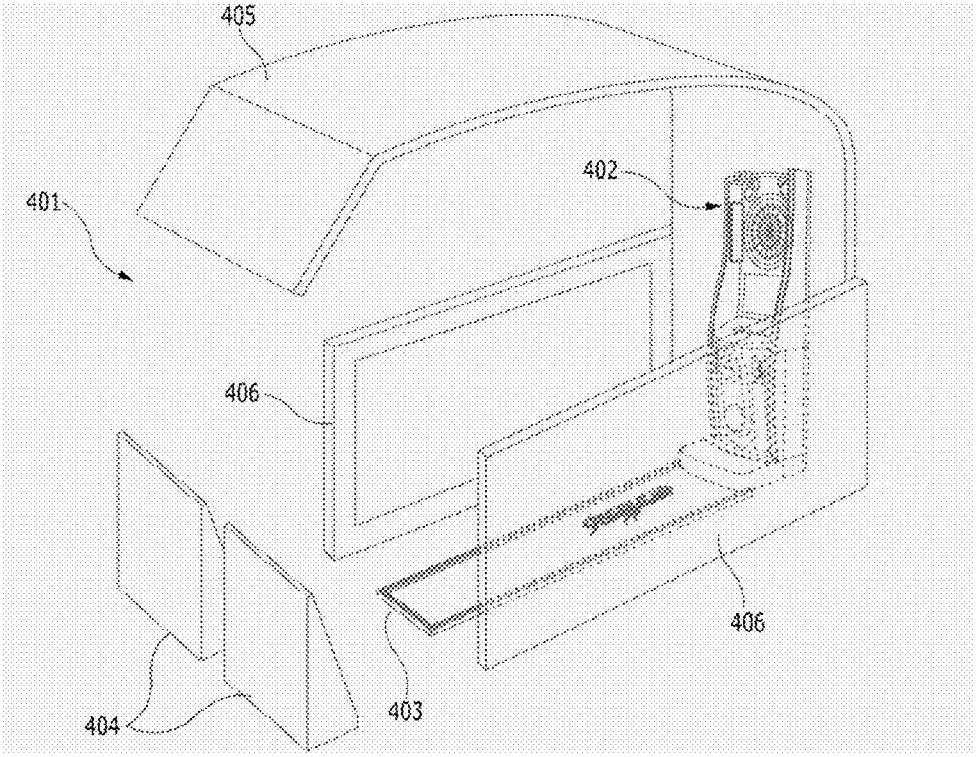
FIG. 4 is a schematic diagram of the dart game device according to some embodiments of the present disclosure.

A dart game device 401 according to some embodiments of the present disclosure is illustrated in FIG. 4.

In some embodiments, the dart game device 401 according to the some embodiments of the present disclosure includes all of a plate structure 403 to be laid under a player of the dart game device 401, a behind structure 404 disposed behind the player, a roof structure 405 roofing the player, one or more side structures 406 disposed on one or more sides of the player, and the like in addition to a body 402 of the dart game device 401. In some embodiments, the structure further includes a booth form, a throw line, a path, a pole, a wall, and the like, but is not limited thereto.

The light source units 22 and the sound source units 28 according to the some embodiments of the present disclosure are installed in some or all of the plate structure 403, the behind structure 404, the roof structure 405, the one or more side structures 406, of the dart game device 401, and the like in addition to the body of the dart game device 401.

According to the some embodiments of the present disclosure, a light source unit 22 and a sound source unit 28 installed in the body of the dart game device 401, a light source unit 22 and a sound source unit 28 installed on the plate structure 403 of the dart game device 401, a light source unit 22 and a sound source unit 28 installed in the behind structure 404, a light source unit 22 and a sound source unit 28 installed in the one or more side structures 406, and the like are interlocked with each other in real time or non-real time, and as a result, a light pattern and a sound pattern of the light source unit 22 and the sound source unit 28 are executed depending on an occurrence of an event.

Figure 5:
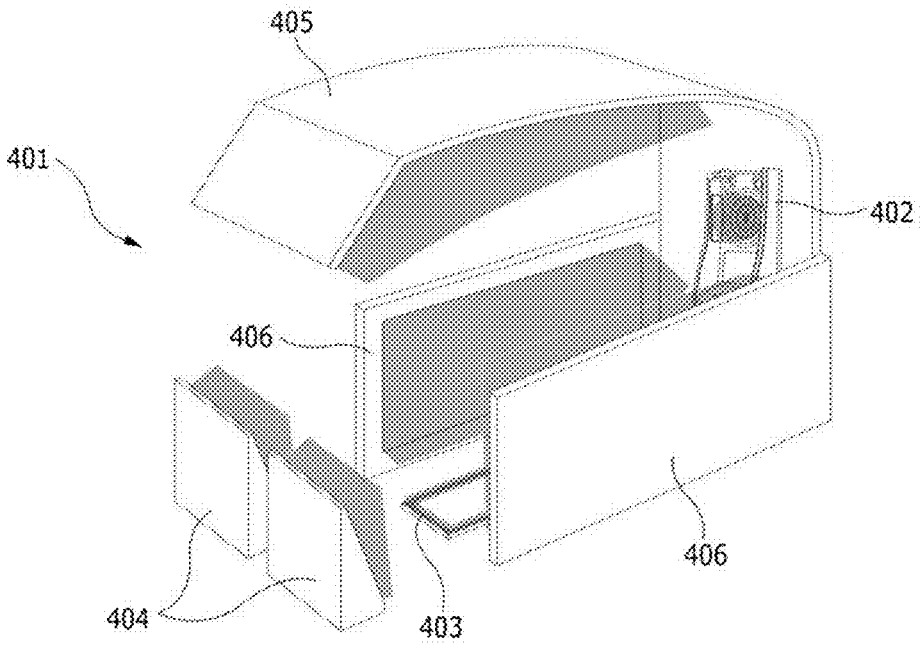
FIG. 5 is a schematic diagram of a light pattern of the dart game device according to some embodiments of the present disclosure.

In some embodiments, referring to FIG. 5, the light source unit 22 installed in the body 402 of the dart game device 401, the light source unit 22 installed on the plate structure 403 of the dart game device 401, the light source unit 22 installed in the behind structure 404, the light source unit 22 installed in the side structures 406, and the like flicker with the same color (for example, blue, and the like) and the sound source units 28 installed in the respective structures generate the same sound (for example, a buzzer sound, and the like) as an event occurs.

Figure 6:
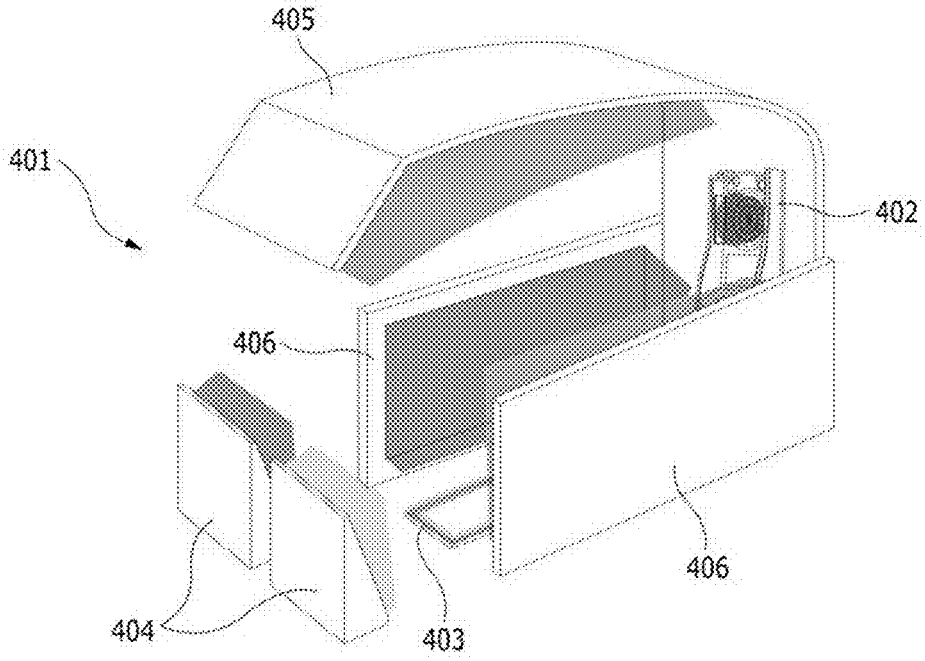
FIG. 6 is a schematic diagram of a light pattern of the dart game device according to some other embodiments of the present disclosure.
Figure 7A:
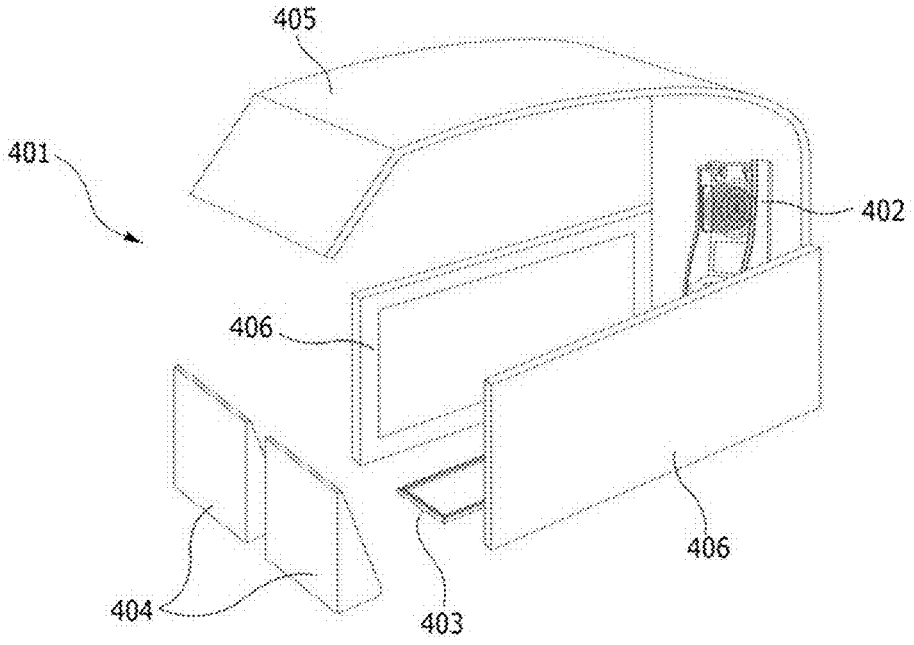
FIGS. 7*a* to 7*e* are schematic diagrams of a light pattern of the dart game device according to some other embodiments of the present disclosure.
Figure 7B:
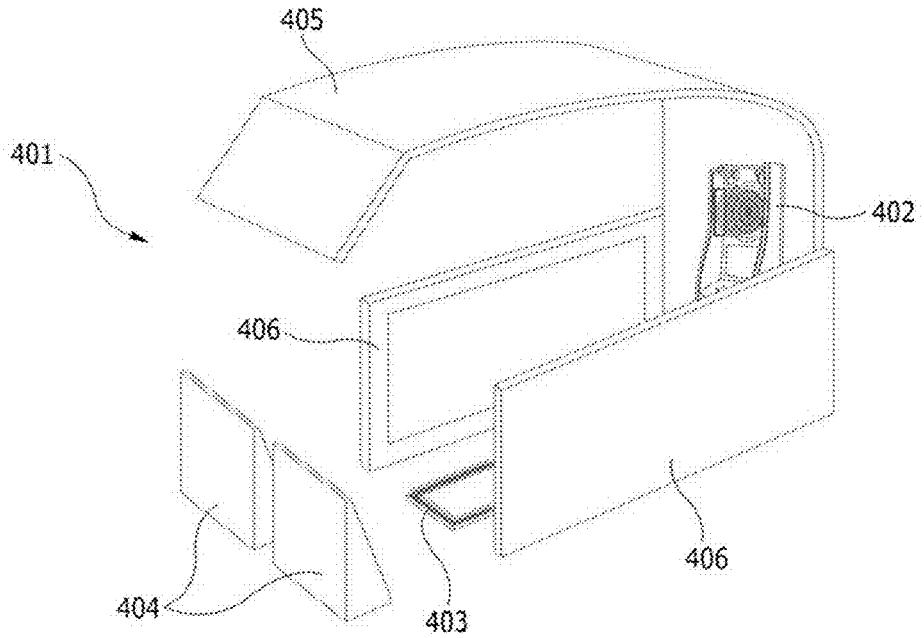
Figure 7C:
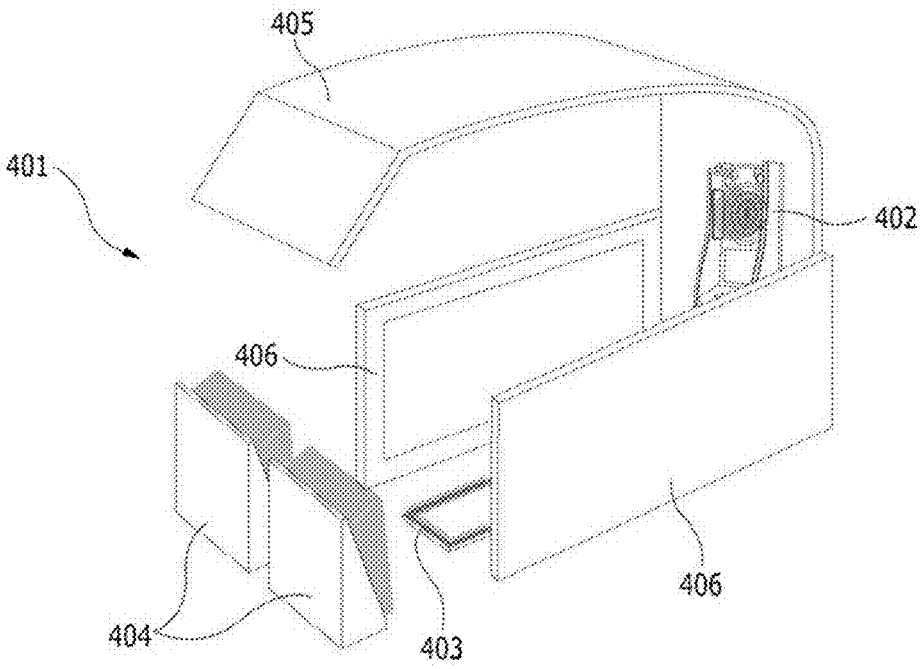
Figure 7D:
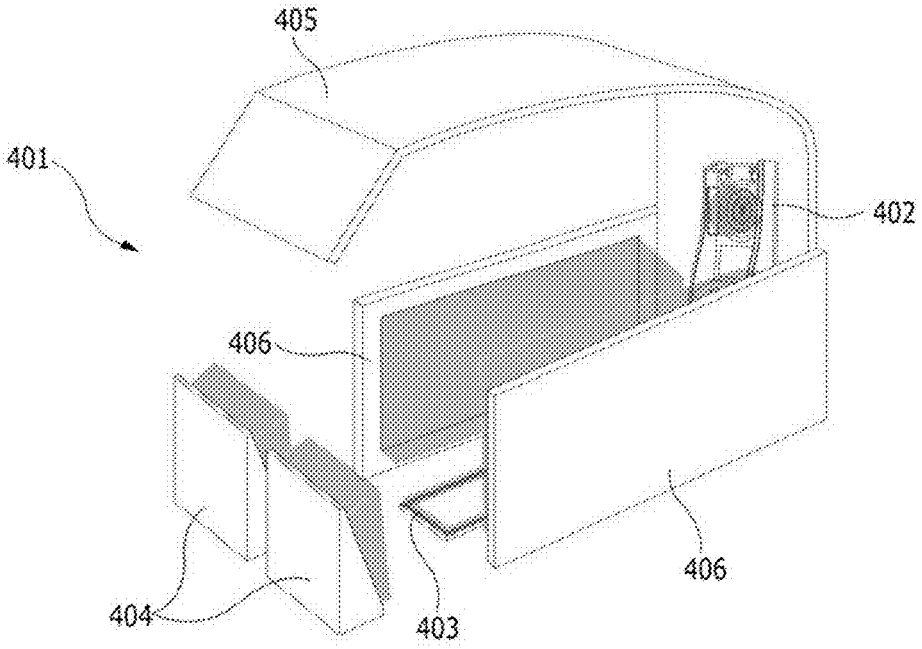
Figure 7E:
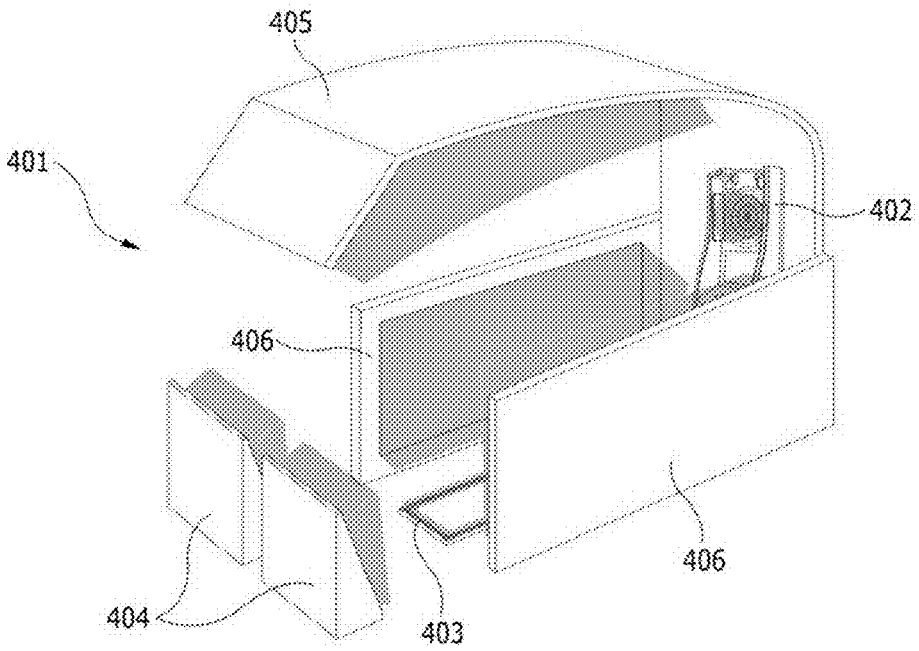

Further, according to some other embodiments, referring to FIG. 6, the light source unit 22 installed in the body 402 of the dart game device 401, the light source unit 22 installed on the plate structure 403 of the dart game device 401, the light source unit 22 installed in the behind structure 404 disposed behind the player, the light source unit 22 installed in the side structures 406, and the like flicker with different colors respectively and the sound source units 28 installed the respective structures generate different sounds, respectively as an event occurs.

Further, according to some other embodiments, referring to FIGS. 7*a* to 7*e*, the light source unit 22 installed in the body of the dart game device, the light source unit 22 installed on the plate structure 403 of the dart game device 401, the light source unit 22 installed in the behind structure 404, the light source unit 22 installed in the side structures 406, and the like sequentially flicker with the same color or different colors and the sound source units 28 installed the respective structures sequentially generate sound as an event occurs.

Referring to FIGS. 7*a* to 7*e*, the light source units 22 are turned on in the order of a target part of the dart game body 402, the plate structure 403, the behind structure 404, the side structures 406, and the roof structure 405, and as a result, a more splendid illumination effect is achieved. The sound source units 28 installed in the respective structures generate sound according to a predetermined order to achieve an enjoyable sound effect.

Figure 8A:
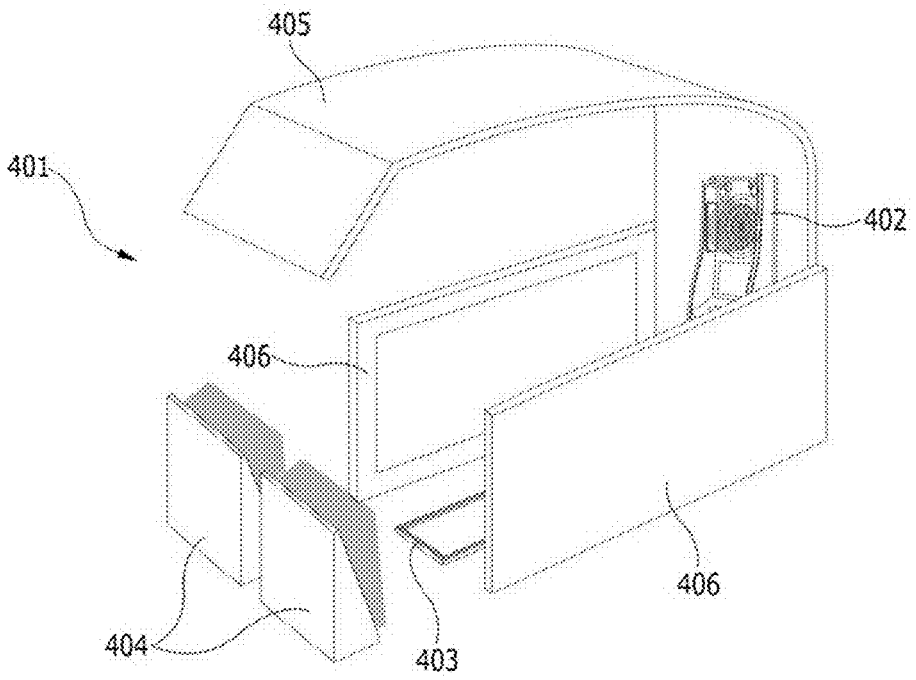
FIGS. 8*a* and 8*b* are schematic diagrams of a light pattern of the dart game device according to some other embodiments of the present disclosure.
Figure 8B:
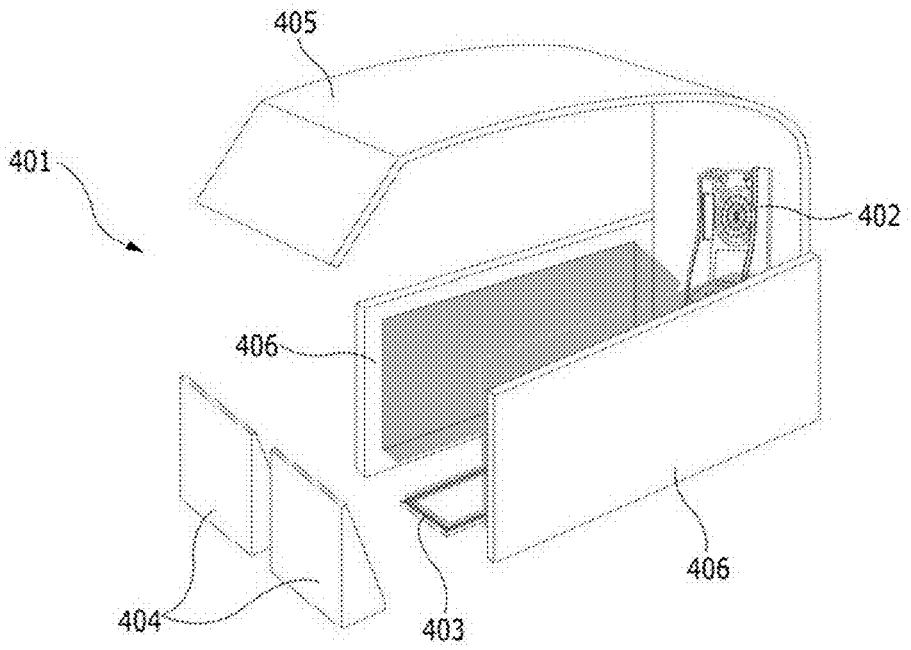

Further, according to some other embodiments, referring to FIGS. 8*a* and 8*b*, as an event occurs, the light source unit 22 installed in the body 402 of the dart game device 401 and the light source unit 22 installed in the behind structure 404 are synchronized to flicker with the same color at the same time, the light source unit 22 installed on the plate structure 403 of the dart game device 402 and the light source unit 28 installed in the side structures 406 are synchronized to flicker with the same color at the same time, and the sound source unit 28 installed in the body 402 of the dart game device 401 and the sound source unit 28 installed in the behind structure 404 are synchronized to generate sound, and the sound source unit 28 installed on the plate structure 403 of the dart game device 401 and the sound source unit 28 installed in the side structures 406 are synchronized to generate the sound.

In FIG. 8*a*, the body and the behind structure 404 of the dart game device 401 are synchronized to be lit up and in FIG. 8*b*, the plate structure 403 and the side structures 406 are synchronized to be lit up.

A form in which the patterns are executed in the light source unit 22 and the sound source unit 28 described as above is an embodiment, but is not limited thereto.

In some embodiments, the facilities 40 mean one or more facilities interlocked with the dart game device 401, and the facilities 40 include, for example, an external dart game device 401, a throw line, a path, a pole, a wall, a table, a chair, and the like. The term "interlocked" includes meanings of "connected," via a physical line or a network line, "synchronized," "linked," and the like. The facilities 40 include light source units 45, the light source units 45 are embedded in the facilities 40, and as the light source units 45, one or more LED lamp are used.

Figure 9:
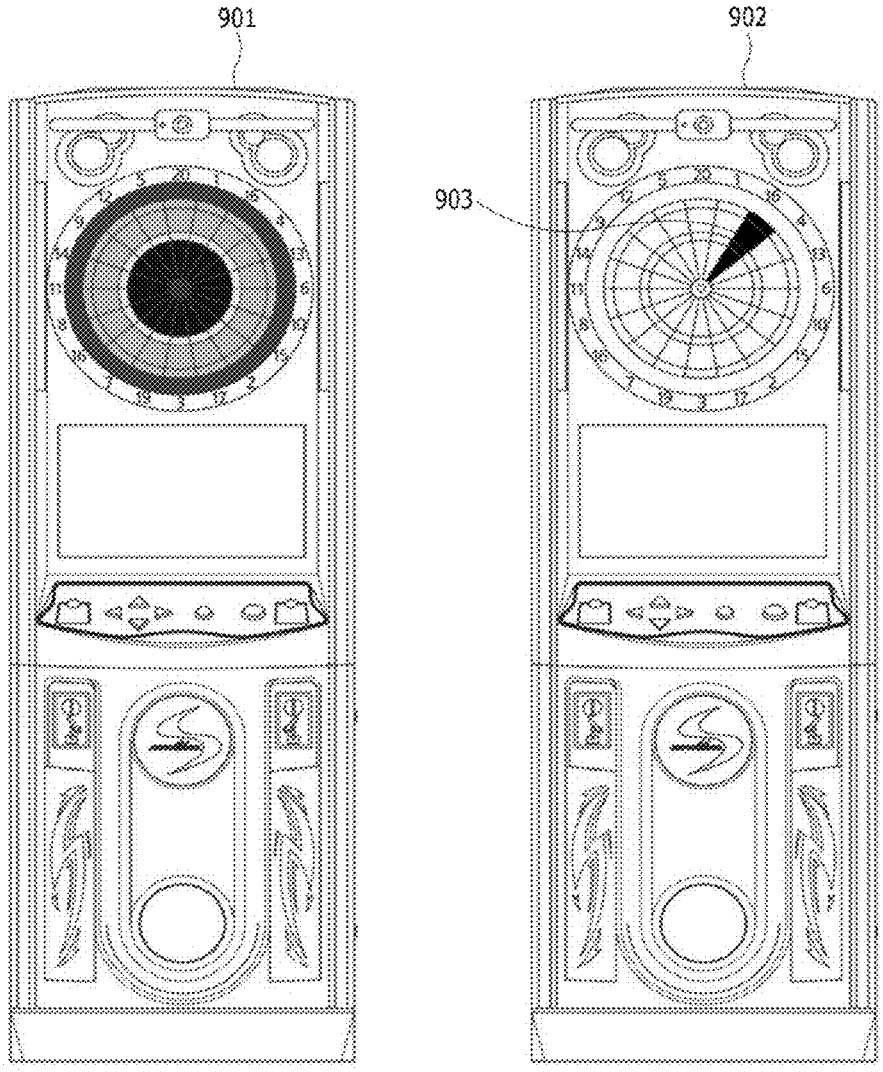
FIG. 9 is a schematic diagram of a dart game device of the present disclosure, which is interlocked with an external device, according to some embodiments of the present disclosure.
Figure 10:
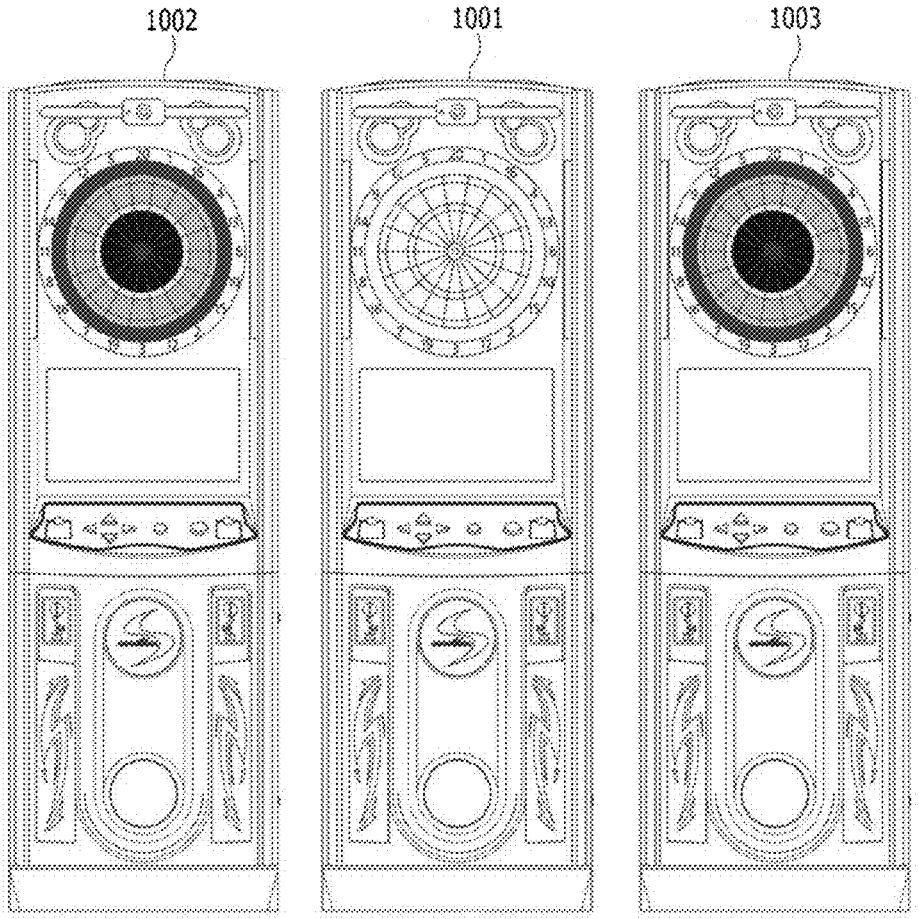
FIG. 10 is a schematic diagram of a dart game device of the present disclosure, which is interlocked with an external device, according to some other embodiments of the present disclosure.
Figure 11:
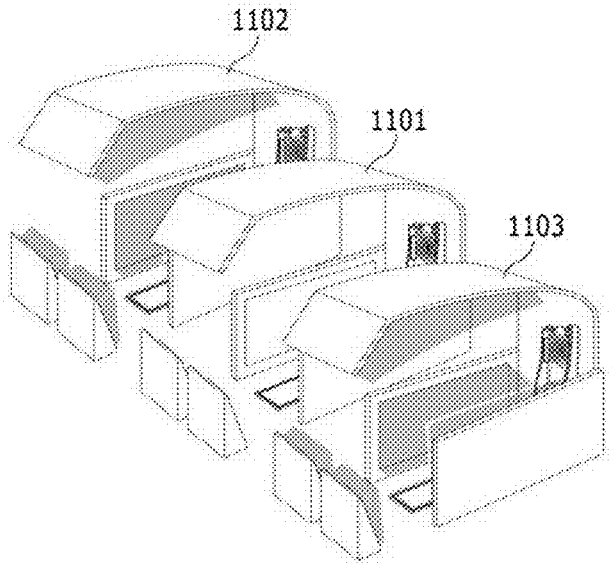
FIG. 11 is a schematic diagram of a dart game device of the present disclosure, which is interlocked with an external device, according to some other embodiments of the present disclosure.

FIGS. 9 to 11 illustrate the case where the facilities 40 are different dart game devices 901, 902, 1001, 1002, 1003, 1101, 1102, and 1103 according to some embodiments of the present disclosure.

As illustrated in FIGS. 9 to 11, a light source unit 22 of a dart game device 901, 902, 1001, 1002, 1003, 1101, 1102, and 1103 of the player and light source units 22 of dart game devices 901, 902, 1001, 1002, 1003, 1101, 1102, and 1103 therearound simultaneously flicker or change light of the light source units 22 simultaneously, and as a result, the player dynamically enjoys the dart game device and further 901, 902, 1001, 1002, 1003, 1101, 1102, and 1103, an interest in the dart game device is also incurred very strongly.

In detail, when two or more players enjoy the dart game in a match-up mode, in the case where one player succeeds in making a predetermined event which is not high in probability, for example, in the case where a red eye is hit continuously three times, light which is very splendid and dazzling in the dart game device of a match-up counterpart occurs or light in which the dart target is not well seen is generated, and as a result, an interest in the game is further incurred.

In this case, when the dart hits a predetermined region of the target, a corresponding region of a target of an external dart game device is deactivated and further, the light flicker.

In some embodiments, as illustrated in FIG. 9, when a player of a dart game device 901 scores a high point, a predetermined target region 903 of an external device 902 is deactivated and although a player of the external device 902 hits the dart on the predetermined target region 903, the hit is recognized as the point.

Further, in some embodiments, as illustrated in FIG. 10, when a player of a dart game device 1001 makes a high point, one or more external devices 1002 and 1003 simultaneously flicker or a specific animation effect is implemented in one or more external devices 1002 and 1003.

Further, when the dart game device 1101 includes a plate structure of the dart game device, a behind structure disposed a player of the dart game device, a roof structure roofing the player, and one or more side structures disposed on one or more sides of the player in addition to a body of the dart game device and one or more external devices 1102 and 1103 as the dart game device each include a plate structure of the dart game device, a behind structure disposed behind a player of the external device, a roof structure roofing the player, one or more side structures, and the like, in addition to the body of the external device, light source units and sound source units installed in the respective structures are implemented in patterns.

In some embodiments, as illustrated in FIG. 11, when the player of the dart game device 1101 hits the red eye continuously three times, by a dart, all of the light source units installed in the dart game device 1101 and the light source units installed in the external devices 1102 and 1103 flicker and patterns of the same sound effect is executed in all of the sound source units.

Referring to FIGS. 12*a* to 12*e*, according to some embodiments of the present disclosure, a dart game device and a plurality of facilities are interlocked with each other.

In some embodiments, the dart game device and the plurality of facilities are presented in a dart game room, a bar, a beerhouse, a restaurant, and the like in which the dart game system is installed.

Figure 12A:
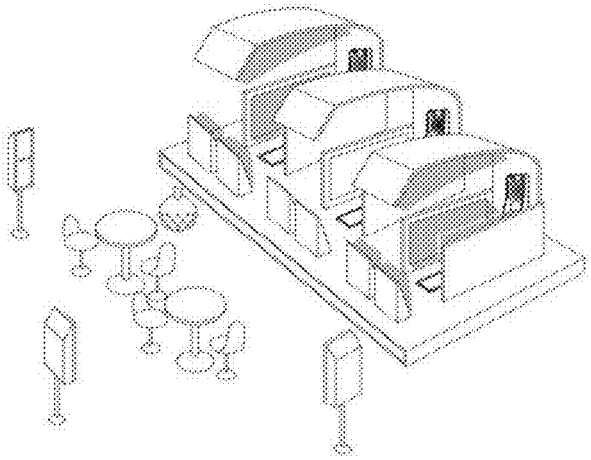
FIGS. 12*a* to 12*e* are schematic diagrams of a dart game device of the present disclosure and a plurality of facilities, which are interlocked with each other, according to some embodiments of the present disclosure.

In some embodiments, when the player of the dart game device keeps a better score like three-sequence red eyes, the external dart game devices are lit up as illustrated in FIG. 12*a*.

Figure 12B:
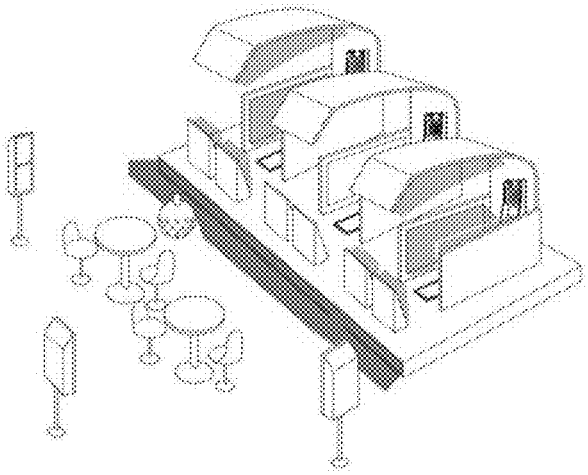
Figure 12C:
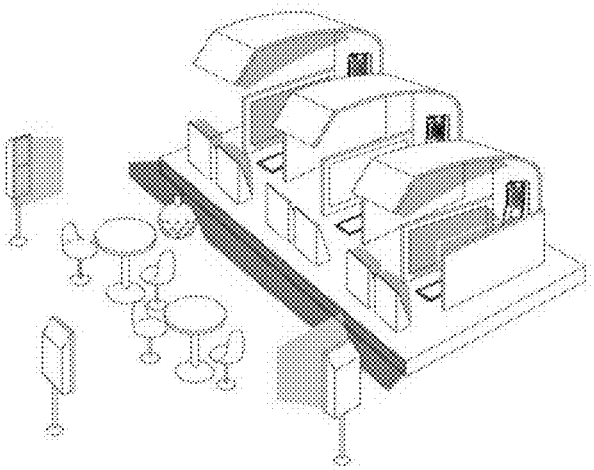
Figure 12D:
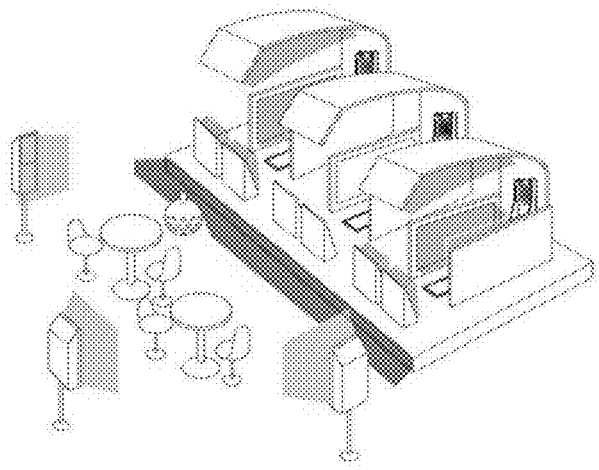

Thereafter, as illustrated in FIG. 12*b*, a side light source unit on a floor is lit up and as illustrated in FIGS. 12*c* and 12*d*, light source units installed in a pole shape in the dart game room, and the like are lit up.

Figure 12E:
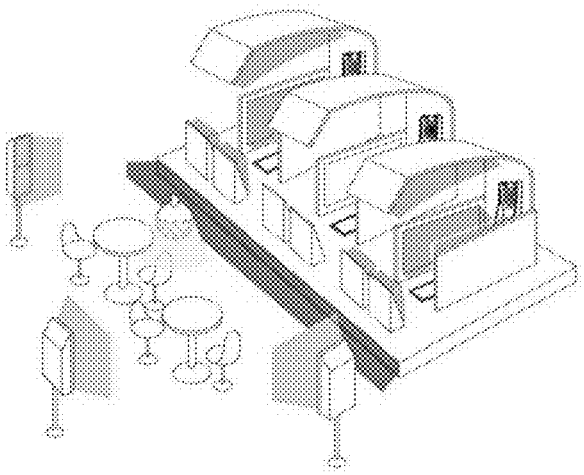

Next, as illustrated in FIG. 12*e*, a light source unit that is hung on a ceiling is lit up.

Besides, when light source units are installed even in the table, the chair, and the like, it is possible that the light source units also execute the pattern of the light source unit according to a predetermined pattern, a pattern read from the memory unit, a pattern received through the communication unit, and the like.

Further, when the sound source units are installed in the dart game device and the plurality of facilities, in some embodiments, the pattern of the sound source unit are executed according to a predetermined pattern determined through the sound source unit, the pattern read from the memory unit, the pattern received through the communication unit, and the like.

In some embodiments, the dart game system includes all facilities including the dart game room, and the like as described above, and since the facilities include the light source units and the sound source units, the light source units and the sound source units execute patterns of illuminations and sounds depending on occurrence of the event, and as a result, the dart game players play the dart game under a more interesting and fantastic atmosphere.

The facility receives the pattern of the light source unit 45 of the facility 40, which is stored in the memory unit 30 from the control unit 10 to execute the corresponding pattern through the light source unit 45.

The memory unit 30 is a part that stores the patterns of the change in flickering scheme and color of the light source unit 22; 45 depending on an occurrence of an event. The memory unit 30 as a memory or a hard disk of a computer stores a dart game program, the patterns of the light source units, voice, a screen, and the like. According to the present disclosure, it is illustrated that the memory unit 30 is installed outside the dart game device in FIG. 1, but, in some embodiments, the memory unit 30 is installed inside the dart game device 20, and one memory unit is illustrated, but a plurality of memory units is installed inside the dart game device 20, inside the facility 40, outside the dart game device 20, and outside the facility 40.

Further, the patterns of the light source units and the sound source units are patterns received from a communication unit 15 having a communication interface, which is included in some or all of the dart game device, the facility, and the like as well as the patterns stored in the memory unit.

Herein, the patterns of the light source units mean the patterns of the change in flickering scheme and color of the illumination or a combination of the patterns.

Further, the pattern of the acoustic pattern of the sound source unit means a pattern of combinations of all sounds issued from the sound source unit.

In addition, the event includes an identification of the player, a hit to a dart target by the dart, a change of the player, game ending, and like. Patterns for a change in various flickering schemes and colors are determine by considering which part of the dart target the dart hits when the dart hits the dart target. The event is an embodiment and it is possible that the event includes all events which occur when executing the dart game.

The control unit 10 is a part that controls the light source units and the sound source units of the dart game device and the facility to execute the patterns depending on the occurrence of the event and further, controls the light source units and the sound source units of the dart game device and the facility to be interlocked with each other.

According to the present disclosure, it is illustrated that the control unit 10 is installed outside the dart game device in FIG. 1, but the present disclosure is not limited thereto, and in some embodiments, the control unit 10 is installed inside the dart game device or inside the facility. Further, only one control unit is illustrated, but the present disclosure is not limited thereto.

The pattern previously stored in the memory unit or the pattern received by the communication unit is executed in some or all of the light source units and the sound source units of the dart game device and the light source units and the sound source units of the facility, by the control by the control unit 10.

In some of the light source units and the sound source units of the dart game device and the light source units and the sound source units of the facility, the pattern is not executed by the control by the control unit 10, but the pattern is executed by a predetermined scheme.

Figure 2:
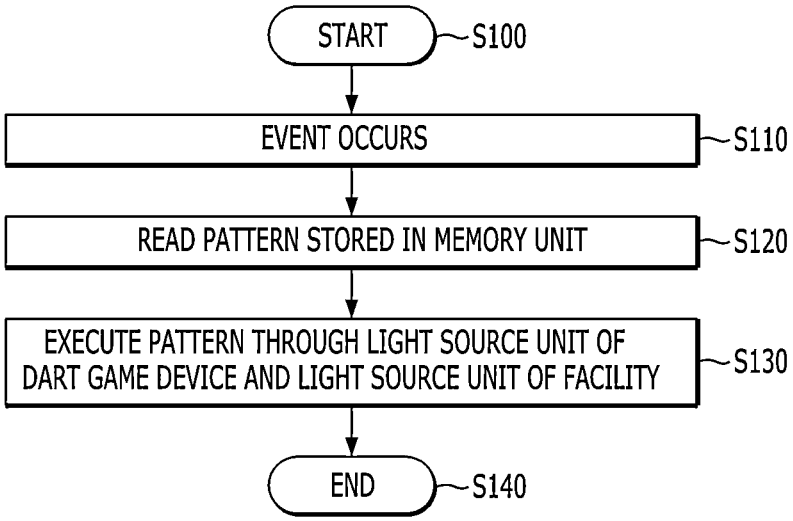
FIG. 2 is a flowchart of a method using a dart game device interlocked with a facility according to some embodiments of the present disclosure.

An execution order when the event occurs in the dart game system including the plurality of facilities will be described with reference to FIG. 2.

When the event occurs (S110), the sensing unit 24 or the control unit 10 recognizes the corresponding event and the control unit 10 reads the pattern previously stored in the memory unit 30 based on contents of the recognized event (S120) and the read pattern is transmitted to the light source unit 22 and the sound source unit 28 of the dart game device and the light source unit 45 and the sound source unit 47 of the facility, and as a result, the pattern is executed (S130).

In some embodiments, the control unit 10 reads or executes the pattern received by the communication unit based on the contents of the recognized event.

Meanwhile, the control unit controls the light source unit and the sound source unit of the facility to execute the patterns only when the event is the hit to the dart target by the dart and the patterns are stored so that the patterns are executed so in a prestored program.

In some embodiments, when the dart game is performed simultaneously in the plurality of dart game devices in the dart game system according to the present disclosure, when the dart hits the dart target simultaneously in the plurality of dart game devices, the control unit compares points of the respective dart game devices, and as a result, only a light pattern and a sound pattern corresponding to a predetermined priority are executed through the light source unit and the sound source unit of the facility.

In some embodiments, when the game is performed in three dart game devices of A, B, and C, if the darts hit the dart targets simultaneously or at a predetermined time interval (when a new dart hits within a time before one pattern starts and ends) in three dart game devices, the respective sensing units of three dart game devices sense regions which the dart hits and the control unit calculates points corresponding to the hit regions to compare the points of A, B, and C. The control unit controls the light source unit and the sound source unit of the facility so that a pattern corresponding to a predetermined priority (for example, a high point, a low point, a winning shot, and the like) is executed through comparison of the points. The control is made by the control unit and by storing a program corresponding to the relevant event in the memory unit in advance.

Figure 3:
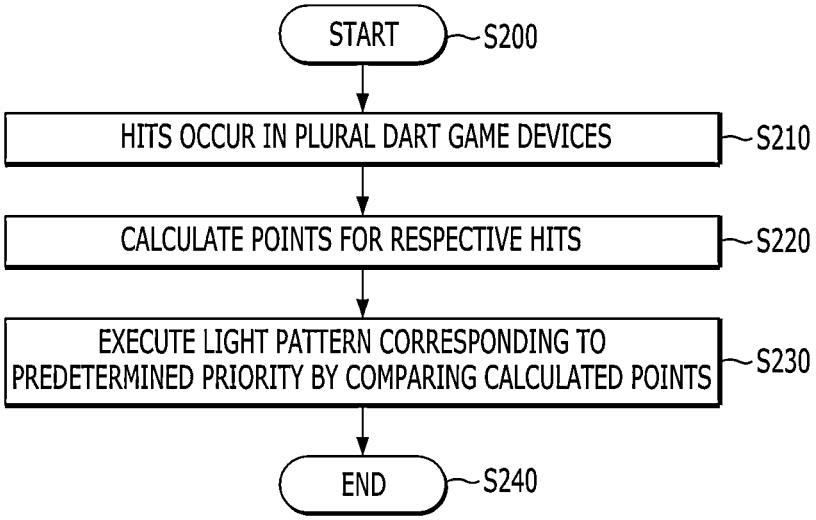
FIG. 3 is a flowchart of a method using a light source unit when hits to a dart target by dart are occurred simultaneously in a plurality of dart game devices, in a dart game device interlocked with a facility according to some embodiments of the present disclosure.

The contents are described through the flowchart as illustrated in FIG. 3.

When the dart hits the dart target simultaneously or at a predetermined time interval in the plurality of dart game devices (S210), hitting in each dart game device is sensed and points for the hitting are calculated (S220) and the points calculated hereinafter are compared, and as a result, only an illumination pattern corresponding to a predetermined priority is executed (S230).

According to the some embodiments of the present disclosure, the dart game device includes a floor part.

In some embodiments, the floor part is configured by a semi-transmissive member and includes a throw line constituted by the light source unit. When the illumination of the light source unit is lit up, the semi-transmissive member is transparent so as for the player to recognize that the illumination is lit up, but when the illumination of the light source unit is turned off, the semi-transmissive member is opaque enough not to determine a position at which the light source unit is buried. Since the light source unit of the throw line is not lit up when the dart game device does not start, the player does not recognize the throw line. However, when the player starts the dart game device, the light source unit is lit up when the game starts at an initial stage to display at least the position of the throw line. The dart game device is a type that is able to start only by inserting a coin and in this case, only when the player starts the game by inserting the coin, the light source unit of the throw line is lit up to display the throw line.

After the dart game device starts and the light source unit of the throw line is lit up, when the patterns of the light source units as a part of the dart game system are executed, the light source unit takes charge of a part of the pattern.

The semi-transmissive member is installed as described above and an illumination capable of displaying at least the throw line is buried therebelow and the light source unit of the throw line is lit up only when the player starts the dart game device in order to prevent an exercise dart from being played on the throw line while the player does not start the dart game device, in particular, does not insert the coin when the dart game device is a type which starts only by inserting the coin. When the player does not start the dart game device, since the player does know an accurate distance of the throw line, it is possible to prevent the player from occupying the dart game device to play the exercise dart. In particular, when the dart game device is a form that starts only by inserting the coin, it is possible to prevent the player from playing the exercise dart without expense.

The description of the presented embodiments is provided so that one who ordinarily skilled in the art of the present disclosure use or implement the dart game system of present disclosure. One who ordinarily skilled in the art would be able to make various modifications of the embodiments, and general principles defined herein is applied to other embodiments without departing from the scope of the present disclosure. Therefore, the present disclosure is not limited to the embodiments presented herein, but should be analyzed within the widest range which is consistent with the principles and new features presented herein.

What is claimed is:

1. A dart game system, comprising: a dart game device including a dart target having a plurality of point regions, a sensing unit sensing hitting by a dart, a light source unit, and a sound source unit; a plurality of facilities including light source units, and sound source units; and a control unit controlling the dart game device and the plurality of facilities, wherein the control unit controls patterns of a change in flickering schemes and colors of the light source units and patterns of sound effects of the sound source units, depending on occurrence of an event, wherein the dart game device further includes at least one of a plate, a structure disposed behind a player, a structure configuring an upper roof above the player, and a structure disposed on a side of the player, wherein the light source unit and the sound source unit are installed in a body of the dart game device, and in the at least one of the plate, the structure disposed behind the player, the structure configuring the upper roof above the player, and the structure disposed on the side of the player, and wherein the light source unit and the sound source unit are interlocked with each other depending on the occurrence of the event, and wherein, when some of the plurality of facilities are dart game devices, in the case where the event is hitting the dart target by the dart, and a dart hits a predetermined region of a dart target of one dart game device, corresponding regions of targets of different dart game devices are deactivated.

2. The dart game system of claim 1, wherein the plurality of facilities includes at least one of a dart game device, a throw line, a path, a pole, a wall, a table, and a chair.

3. The dart game system of claim 1, wherein the event includes identification of the player, hitting the dart target by the dart, a change of the player, and game ending.

4. The dart game system of claim 2, wherein, when one or more facilities among the plurality of facilities are dart game devices, in the case where darts hit dart targets simultaneously or at a predetermined time interval in the dart game devices, only a light pattern and a pattern of sound effect corresponding to a predetermined priority are executed through the light source units and the sound source units.

5. The dart game system of claim 1, wherein each of the dart game device and the plurality of facilities further includes a communication unit having a communication interface, and the dart game device and the plurality of facilities are capable of exchanging the patterns of the change in flickering schemes and colors of the light source units and the patterns of the sound effects of the sound source units by using the communication units.

6. The dart game system of claim 1, wherein, when some of the plurality of facilities are dart game devices, the dart game devices are capable of playing a dart game with each other.

7. The dart game system of claim 6, wherein each of the dart game devices includes a communication unit having a communication interface, and wherein the dart game devices are capable of playing the dart game with each other through the communication unit.

8. The dart game system of claim 1, further comprising: a memory unit storing the patterns of the change in flickering schemes and colors of the light source units and the patterns of the sound effects of the sound source units depending on the occurrence of the event.

9. The dart game system of claim 8, wherein the patterns are read from the memory unit and executed by the light source units and the sound source units.

10. The dart game system of claim 8, wherein each of at least some of the dart game device and the plurality of facilities includes a communication unit having a communication interface.

* * * * *